US009624689B2

(12) United States Patent
Bailey et al.

(10) Patent No.: US 9,624,689 B2
(45) Date of Patent: Apr. 18, 2017

(54) RETRACTABLE CANOPY

(71) Applicant: Outdoor Living Manufacturing Ltd., Maple Ridge (CA)

(72) Inventors: Greg Bailey, New Westminster (CA); Terry James Brown, Vancouver (CA); Andrew John Barron, New Westminster (CA)

(73) Assignee: Outdoor Living Manufacturing Ltd., Maple Ridge, BC (CA)

( * ) Notice: Subject to any disclaimer, the term of this patent is extended or adjusted under 35 U.S.C. 154(b) by 0 days.

(21) Appl. No.: 14/802,205

(22) Filed: Jul. 17, 2015

(65) Prior Publication Data

US 2017/0016245 A1 Jan. 19, 2017

(51) Int. Cl.

| | |
|---|---|
| ***E04H 15/32*** | (2006.01) |
| ***E06B 9/24*** | (2006.01) |
| ***E06B 9/58*** | (2006.01) |
| ***E06B 9/80*** | (2006.01) |
| *E06B 9/262* | (2006.01) |

(52) U.S. Cl.

CPC ..... *E04H 15/32* (2013.01); *E06B 9/24* (2013.01); *E06B 9/58* (2013.01); *E06B 9/581* (2013.01); *E06B 9/80* (2013.01); *E06B 2009/2423* (2013.01); *E06B 2009/2622* (2013.01)

(58) Field of Classification Search

CPC . E04H 15/32; E04F 10/02; E06B 9/58; E06B 9/581; E06B 9/24; E06B 9/80; E06B 2009/2423; E06B 2009/2622

USPC ..... 160/84.01

See application file for complete search history.

(56) References Cited

U.S. PATENT DOCUMENTS

| | | | | |
|---|---|---|---|---|
| 2,832,362 A | | 4/1958 | Critoph | |
| 3,801,176 A | | 4/1974 | Higbee | |
| 4,557,310 A | | 12/1985 | Castellaw et al. | |
| 4,741,375 A | | 5/1988 | Milford et al. | |
| 4,789,210 A | | 12/1988 | Weiss et al. | |
| 4,880,045 A | * | 11/1989 | Stahler | E06B 9/262 160/207 |
| 5,111,866 A | * | 5/1992 | Prostko | E06B 9/262 160/276 |
| 5,439,281 A | | 8/1995 | Croker | |

(Continued)

FOREIGN PATENT DOCUMENTS

| | | | |
|---|---|---|---|
| DE | 4021264 | A1 | 1/1992 |
| DE | 102006038106 | A1 | 2/2008 |

(Continued)

*Primary Examiner* — Blair M Johnson

(74) *Attorney, Agent, or Firm* — Todd A. Rattray; Oyen Wiggs Green & Mutala LLP

(57) ABSTRACT

Aspects of the present disclosure provide retractable canopies, kits of parts for assembling retractable canopies, and methods for assembling and operating retractable canopies. The retractable canopies provide tracks extending in a longitudinal direction and transversely spaced apart. A support extends in a transverse direction between the tracks and is moveably coupled to the tracks via mounts to the tracks. The mounts include engagement members, such as wheels, to engage with the tracks. The engagement members may be biased transversely away from the support (e.g. toward the track), thereby permitting the engagement members to adjust their transverse positions relative to the support as the support moves along the track.

20 Claims, 6 Drawing Sheets

(56) References Cited

U.S. PATENT DOCUMENTS

| | | | | |
|---|---|---|---|---|
| 5,597,217 | A | 1/1997 | Hoska et al. | |
| 5,794,679 | A | 8/1998 | Williams et al. | |
| 6,006,809 | A | 12/1999 | Williams et al. | |
| 6,199,337 | B1 * | 3/2001 | Colson | E04B 9/00 160/327 |
| 6,796,357 | B2 | 9/2004 | Kirby | |
| 2004/0074157 | A1 | 4/2004 | Chazal | |
| 2008/0142064 | A1 * | 6/2008 | Maraki | E04F 10/0607 135/121 |

FOREIGN PATENT DOCUMENTS

| | | | |
|---|---|---|---|
| DE | 202008006223 | U1 | 10/2008 |
| EP | 1964998 | B1 | 9/2008 |
| WO | 00 09831 | A1 | 2/2000 |
| WO | 2004 079125 | A2 | 9/2004 |

* cited by examiner

RETRACTABLE CANOPY

TECHNICAL FIELD

The present disclosure relates to canopies for buildings and other structures, and in particular to retractable canopies.

BACKGROUND

Many structures, and especially outdoor structures such as gazebos and pergolas, are provided with canopies to provide shade and/or shelter. At times, however, it may be desirable for such structures to be uncovered. To accommodate the desire for certain structures to be covered at some times and uncovered at other times, some manufacturers provide retractable or otherwise adjustable canopies. Such canopies may be retracted (to leave all or part of the structure uncovered) and/or extended (or cover all or part of the structure), as desired.

Retractable canopies are commonly constructed according to particular dimensions, may be laborious to assemble, and/or may require a certain degree of precision in assembly and installation to provide for smooth operation. These characteristics of prior art canopies may reduce the convenience of retractable canopies for some users. For example, these characteristics of prior art canopies may be disadvantageous for users who wish to install a canopy in a structure with dimensions which do not correspond to those of the canopy, or for users who lack experience in canopy assembly and installation.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

Aspects of the present disclosure provide a retractable canopy, a kit of parts for assembling a retractable canopy, and a method for assembling a retractable canopy. The retractable canopy comprises first and second tracks extending in a longitudinal direction and spaced apart from one another in a transverse direction. A first support extends transversely between the first and second tracks. The canopy further comprises mounts for movably coupling the first support to the first and second tracks. The mounts comprise a first mount for movably coupling the first support to the first track. The first mount comprises an engagement member engaged to the first track and a bias mechanism coupled between the engagement member and the first support. The first bias mechanism resiliently forces the engagement member transversely away from the first support. The canopy further comprises a flexible canopy panel, at least a first portion of which is coupled to the first support.

In some embodiments, the engagement member comprises a wheel and the first track comprises a track cavity for receiving the wheel. The wheel may be movable in the longitudinal direction within the track cavity.

In some embodiments, the first track comprises a protrusion extending into the track cavity. The protrusion extends along the first track in the longitudinal direction. A circumferential surface of the wheel comprises a groove shaped to receive the protrusion during movement of the wheel in the longitudinal direction within the track cavity. The protrusion may comprise a convex surface and the groove may comprise a concave surface which is shaped to be complementary to the convex surface. In some embodiments, the first track comprises a groove and the circumferential surface of the wheel comprises a protrusion.

In some embodiments, the first support comprises a transversely opening mounting cavity for receiving the mount and a transversely opening panel cavity for receiving at least a portion of the canopy panel. The panel cavity may extend in the transverse direction along the first support. The first support may define a panel aperture extending in the transverse direction along a surface of the first support. The canopy panel may comprise a panel retainer coupled to the first end of the canopy panel. The panel retainer may extend in the transverse direction and be retained in the panel cavity. The panel retainer may have a retainer dimension in a cross-sectional direction greater than an aperture dimension of the panel aperture in the cross-sectional direction. The canopy panel may pass through the panel aperture.

In some embodiments, the canopy comprises a second support and a second canopy panel. The second support extends transversely between the first and second tracks. At least a portion of the second canopy panel is coupled to the second support. The second canopy panel comprises a second panel retainer extending in the transverse direction and retained in the panel cavity of the first support. A second retainer dimension of the second panel retainer in the cross-sectional direction is greater than the aperture dimension of the panel aperture in the cross-sectional direction, and the sum of the retainer dimension and second retainer dimension is less than a dimension of the panel cavity of the first support in the cross-sectional direction.

In some embodiments, the mount comprises a cap. The cap comprises a body abutting a first transverse end of the first support and a retention member. The retention member extends transversely into the mounting cavity and retained by the first support.

The cap may define an axle cavity extending in the transverse direction. In some embodiments, the bias mechanism may comprise an axle, an axle stop, and a spring. The axle is coupled at a first axle portion to the engagement member and at a second axle portion to the cap. The first axle portion is slidably movable relative to the second axle portion and the second axle portion is received by the axle cavity. The axle stop is coupled to the second axle portion and the cap. The spring is positioned between and retained by the first axle portion and the axle stop. The spring resiliently biases the first axle portion away from the axle stop and towards the track cavity.

In some embodiments, the cap defines an axle cavity extending in the transverse direction and the bias mechanism comprises an axle, a stop defined in the axle cavity by the cap, and a spring. The axle is coupled at a first axle portion to the engagement member and at a second axle portion to the cap. The first axle portion is fixed relative to the second axle portion, and the second axle portion is retained in the axle cavity. A spring is positioned between and retained by the second axle portion and the stop. The spring resiliently biases the axle away from the stop and toward the track cavity.

In some embodiments, the first support comprises a magnet. The magnet attracts the first support to the second support.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Aspects of the present disclosure provide retractable canopies, kits of parts for assembling retractable canopies, and methods for assembling and operating retractable canopies. The retractable canopies provide tracks extending in a longitudinal direction and transversely spaced apart. A support extends in a transverse direction between the tracks and is moveably coupled to the tracks via mounts to the tracks. The mounts include engagement members, such as wheels, to engage with the tracks. The engagement members may be biased transversely away from the support (e.g. toward the track), thereby permitting the engagement members to adjust their transverse positions relative to the support as the support moves along the track.

Figure 1A:
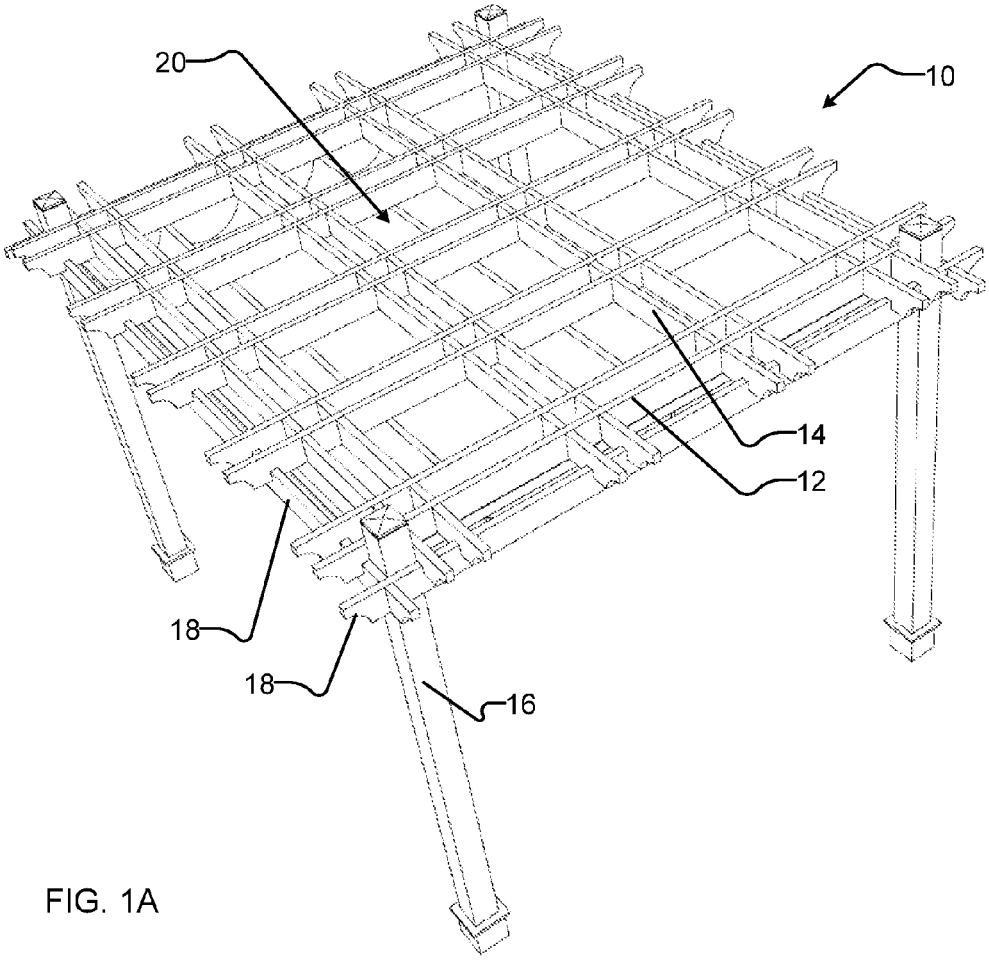
FIG. 1A is a perspective view of an example structure with an example retractable canopy, shown from above.
Figure 1B:
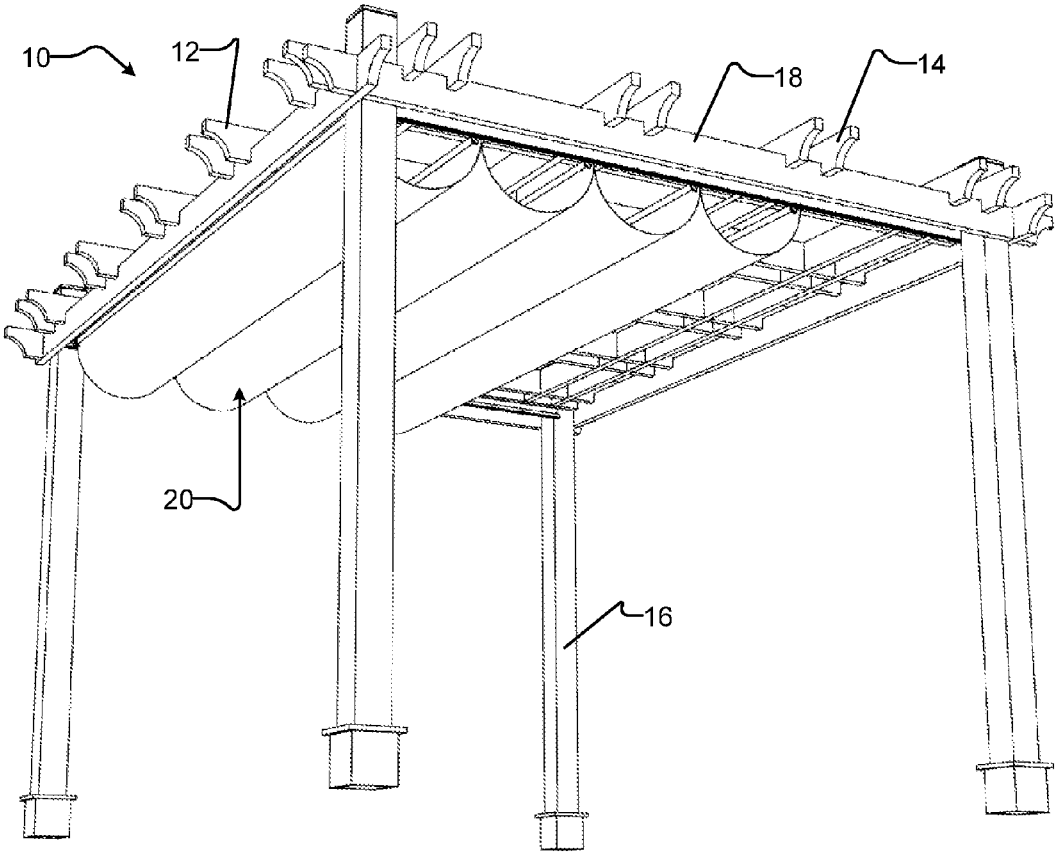
FIG. 1B is a perspective view of the example structure with an example retractable canopy of FIG. 1A, shown from below.

FIG. 1A and FIG. 1B (individually and collectively "FIG. 1") show an example structure 10. The depicted structure 10 is a pergola, although those skilled in the art will appreciate that a variety of structures may be suitable for the purposes of the present disclosure. Structure 10 comprises a lattice of longitudinal braces 12 intersecting with transverse braces 14. Braces 12, 14 are supported by legs 16, which also support frame 18 (which, in this example, comprises additional braces offset from braces 12, 14). Canopy 20 is supported by frame 18 (which may comprise braces 12, 14). Those skilled in the art will appreciate that canopy 20 may be otherwise supported; for example, a portion of canopy 20 may be affixed to a surface of an adjacent structure, such as a wall of a building.

Figure 2A:
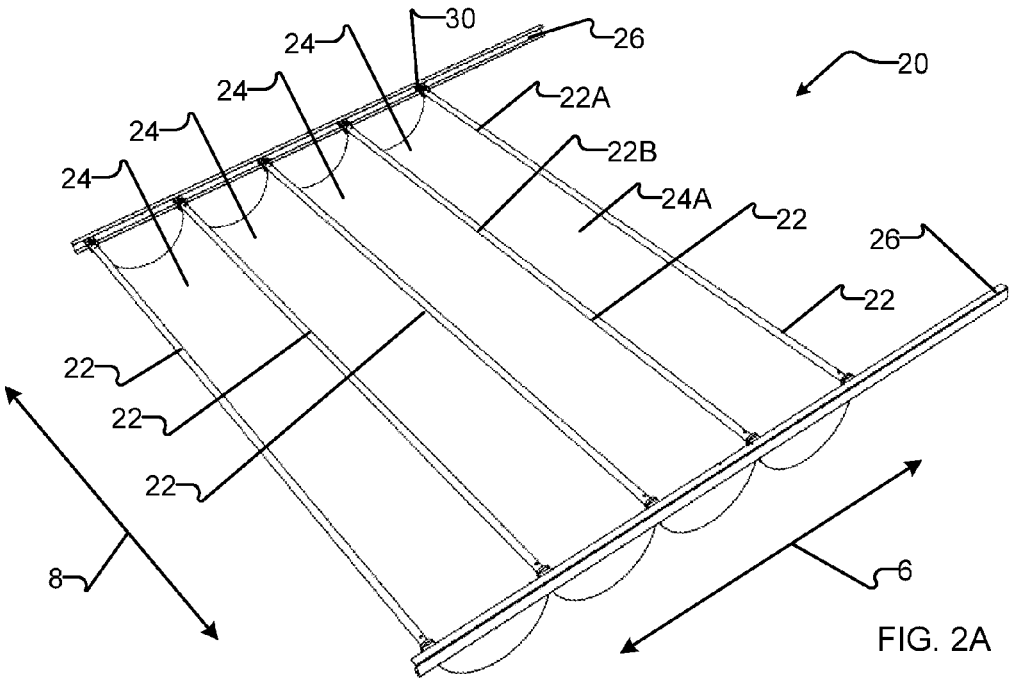
FIG. 2A is a perspective view of the example retractable canopy of FIG. 1A, shown from above.
Figure 2B:
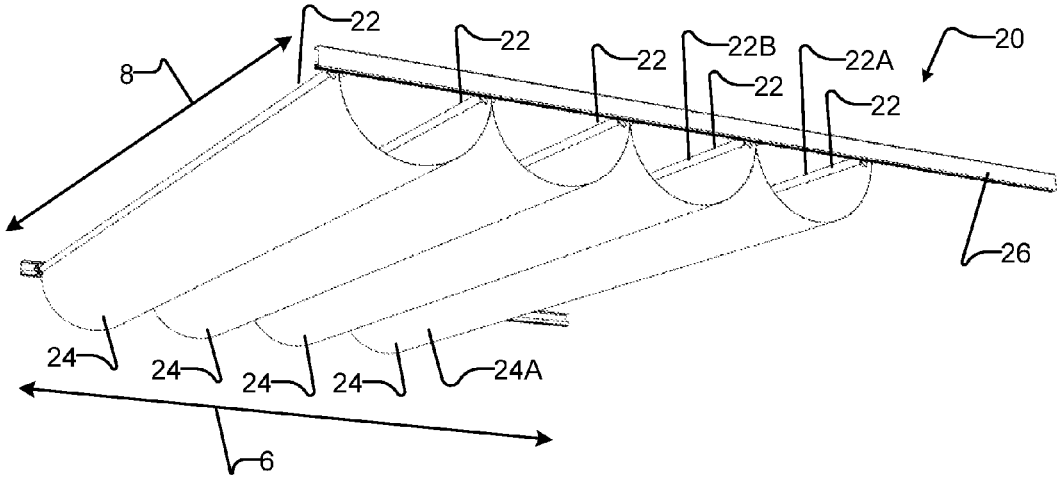
FIG. 2B is a perspective view of the example retractable canopy of FIG. 1A, shown from below.

FIG. 2A and FIG. 2B (individually and collectively "FIG. 2") show the example canopy 20 of FIG. 1 and omit structure 10, for clarity. Canopy 20 comprises supports 22 which extend in transverse direction 8 and support panels 24. Supports 22 may comprise rods, tubes, bars, and/or other geometries and may be straight, curved, and/or otherwise shaped, so long as supports 22 are capable of supporting panels 24. Supports 22 may be made of any suitable material, such as plastics, metals, and/or other materials. Supports 22 may be relatively more rigid (i.e. less deformable) than panels 24. In some embodiments, supports 22 comprise aluminum tubes.

Supports 22 may be of any suitable dimension. For example, in some embodiments, supports 22 may extend approximately 2 to 6 meters in transverse direction 8. For instance, supports 22 may extend approximately 391.8 cm (154.25 inches) in transverse direction 8. Supports 22 may be telescoping, resilient, or otherwise capable of changing their dimension in transverse direction 8. Supports 22 may comprise tubes having a radial diameter of 1.5875 cm (0.625 inches) and a wall thickness of 0.16 cm (0.063 inches).

Panels 24 are supported by and extend between supports 22. Canopy 20 may comprise one or more panels 24. In some embodiments, canopy 20 comprises a single panel 24 supported by each of a plurality of supports 22. For example, panels 24 may be threaded through channels in some or all supports 22. In some embodiments, canopy 20 comprises a plurality of panels 24, each panel 24 supported by a subset of the plurality of supports 22. For example, each panel 24 may be supported by a pair of supports 22 which are adjacent to one another in longitudinal direction 6. For instance, as shown in FIG. 2A, example panel 24A may be coupled at a first end to first support 22A and at a second end to second support 22B; other panels 24 may be similarly coupled at opposing ends to supports 22 which are adjacent to one another in longitudinal direction 6. Such multi-panel embodiments may permit canopy 20 to be relatively easily expanded in longitudinal direction 6, which may assist in allowing for relatively rapid assembly of canopy 20.

Supports 22 supporting panels 24 may move relative to other supports 22. Panels 24 may be designed to accommodate relative movement of supports 22 while panels 24 are being supported by supports 22. For example, panels 24 may comprise a flexible material, as depicted in FIG. 1 and FIG. 2. Alternatively, or in addition, panels 24 may comprise rigid materials which telescope, overlap, or are otherwise capable of reducing or expanding their dimension in longitudinal direction 6 to permit relative movement of supports 22. Panels 24 may be made of any material suitable for a canopy, such as transparent, translucent, or opaque materials; fabrics; plastics; metals; and/or other materials. For example, panels 24 may comprise an acrylic-coated polyester or other material providing sufficient tensile strength, water repellence, mildew resistance, ultraviolet light resistance, and/or other qualities. For instance, panels 24 may be made from Harbor-Time® fabrics.

Supports 22 are coupled to tracks 26 via mounts 30. Tracks 26 are spaced apart from one another in transverse direction 8 and extend in longitudinal direction 6. Supports 22 extend in transverse direction 8 between tracks 26. One or more of supports 22 are movable relative to tracks 26 in longitudinal direction 6. Tracks 26 may comprise any suitable shape and dimension for the mounting of supports 22 via a mount. For example, tracks 26 may comprise rails, gaskets, sliding tracks, channels, bars, tubes, and/or other geometries and may be straight, curved, and/or otherwise shaped, so long as supports 22 are able to be coupled to and move along the length of tracks 26 in longitudinal direction 6. Tracks 26 may be made of any suitable material, such as plastics, metals, and/or other materials. In some embodiments, tracks 26 comprise aluminum channels.

Tracks 26 may be of any suitable dimension. For example, tracks 26 may be approximately 1 to 5 meters long in longitudinal direction 6. For instance, tracks 26 may be approximately 2.5 m (approximately 8 feet) long in longitudinal direction 6. Tracks 26 may be shorter or longer, as appropriate, and/or multiple tracks 26 may be arranged in series to provide for a greater dimension in longitudinal direction 6.

Figure 3:
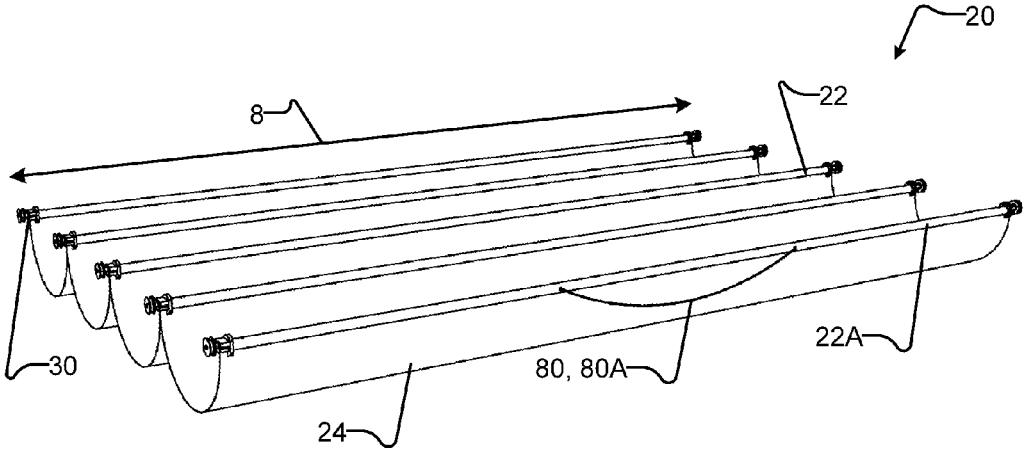
FIG. 3 is a perspective view of the example retractable canopy of FIG. 1A with the track omitted, thereby exposing example mounts attached to example supports.

FIG. 3 shows an example canopy 20 with tracks 26 omitted, thereby exposing example mounts 30. In the example embodiment of FIG. 3, mounts 30 extend in transverse directions 8 from the ends of supports 22. In some embodiments, each mount 30 comprises an engagement member 32 that engages track 26. Engagement member 32 may be moveable in transverse direction 8 relative to support 22 while engaged with track 26. Thus, as support 22 moves relative to track 26 in longitudinal direction 6, movement of engagement member 32 toward or away from support 22 may compensate for variations in the distance between opposing tracks 26 in the transverse direction (e.g. if tracks 26 are not perfectly parallel, or if a particular track 26 has some irregularity in its shape).

In some embodiments, engagement member 32 may be biased (e.g. forced) away from support 22 and toward track 26. Such biasing may assist, for example, in providing smoother motion of supports 22 as they move relative to tracks 26 in longitudinal direction 6. In some embodiments, one or more supports 22 each have a plurality of mounts 30 with biased engagement members 32 (e.g. mounts 30 may be coupled to supports 22 at opposing transverse ends 61, shown in FIG. 5). In some embodiments, one or more supports 22 each have exactly one mount 30 with a biased engagement member 32 coupling the support to a first track 26. Those singly-biased supports 22 may each have one or more additional mounts 30 with unbiased engagement members 32, and/or maybe otherwise coupled to other tracks 26. Such additional mounts 30 may be designed to allow transverse movement of their respective unbiased engagement members 32 while engaged with track 26, thereby enabling the biasing action of biased engagement members 32 to cooperate with the movement of unbiased engagement members 32 to bias support 22 in transverse direction 8.

Figure 4:
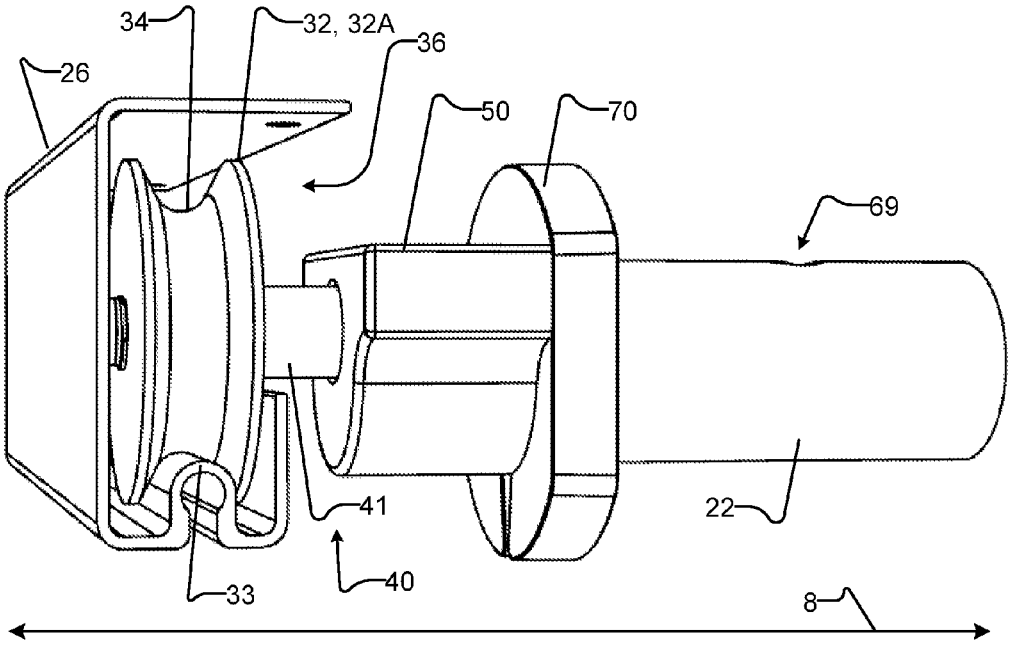
FIG. 4 is a perspective view of the example mount of FIG. 3.

FIG. 4 shows the example mount 30 of FIG. 3 in greater detail. In FIG. 4, mount 30 is shown engaged in track 26. The example mount 30 comprises an engagement member 32 engaged in a cavity 36 of track 26. Engagement member 32 is coupled to bias mechanism 40, which biases engagement member 32 in transverse direction 8 away from transverse end 61 of support 22 (e.g. toward track 26). Bias mechanism 40 is coupled to support 22, thereby coupling engagement member 32 to support 22. Bias mechanism 40 is shown in greater detail in FIG. 5.

In the example embodiment of FIG. 4, engagement member 32 comprises a wheel 32A and bias mechanism 40 comprises an axle 41 and a cap 50. Wheel 32A is rotatably coupled to axle 41, which is biased against and extends from cap 50 in transverse direction 8. In some embodiments, engagement member 32 (e.g. wheel 32A) is shaped to complement one or more features of track 26. For example, in the FIG. 4 embodiment, track 26 comprises a protrusion 33 and wheel 32A comprises a circumferential groove 34 which may receive protrusion 33 as wheel 32A rolls in longitudinal direction 6 in cavity 36. For instance, protrusion 33 may have a convex surface complementary to a corresponding concave surface of groove 34. In some embodiments, this may be reversed. For example, track 26 may comprise one or more suitably shaped concavities which are complementary to one or more suitably shaped convexities on engagement member 32.

Figure 5:
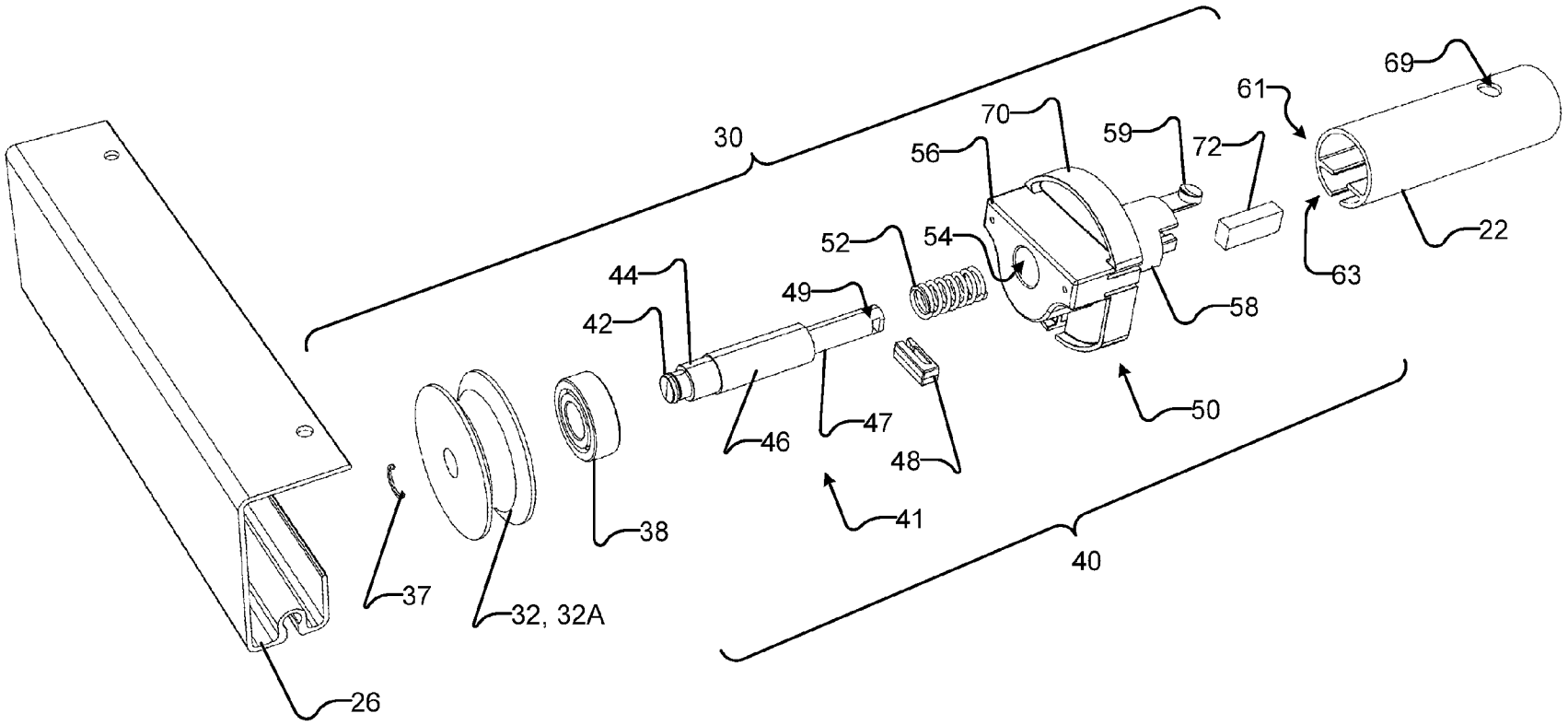
FIG. 5 is an exploded perspective view of the example mount of FIG. 3.

FIG. 5 shows an exploded view of an example mount 30, shown between track 26 and support 22. In particular, FIG. 5 shows components of an example bias mechanism 40 and an example cap 50 in greater detail. The example bias mechanism 40 comprises a bearing 38 coupled to axle 41, which extends from cap 50. Axle 41 is coupled to engagement member 32 at one end and cap 50 is coupled to support 22 at an opposing end.

In some embodiments, at least a portion of axle 41 is movable in transverse direction 8 relative to transverse end 61 of support 22. For example, axle 41 may be extendable (e.g. telescopically), thereby permitting the movement of a first portion 46 of axle 41 (to which wheel 32A may be coupled) relative to a second portion 47 of axle 41 (which may be coupled to cap 50). As another example, axle 41 may be of fixed dimension in transverse direction 8, and axle 41 as a whole may be moveable in transverse direction 8 relative to transverse end 61 of support 22. This movement of at least a portion of axle 41 may be biased in transverse direction 8 away from transverse end 61 of support 22 (e.g. towards track 26).

In the illustrated embodiment, axle 41 comprises a first portion 46 and a second portion 47. First portion 46 slides over second portion 47 and second portion 47 is received in a transversely oriented bore of first portion 46, thereby permitting axle 41 to telescope by relative transverse movement between first and second portions 46, 47. First portion 46 has a first surface 42 on which wheel 32A (or other engagement member 32) may be coupled. Wheel 32A may be retained on first surface 42 by any suitable mechanism, such as C-clip 37. A bearing 38 may be coupled to second surface 44 of first portion 46 and may bear against wheel 32A to provide smooth rotational motion.

The telescoping motion of axle 41 may be biased (e.g. forced) away from transverse end 61 of support 22, e.g. as described above. In some embodiments, a spring 52 is retained by axle 41 and biases first portion 46 away from transverse end 61. For example, spring 52 may wrap around second portion 47 and be retained between first portion 46 and stop 48. Stop 48 may be retained in aperture 49. Second portion 47 may be coupled to cap 50 so that first portion 46 moves telescopically relative to cap 50 in transverse direction 8. For example, second portion 47 may be received in aperture 54 defined in body 56 of cap 50. Stop 48 may engage with cap 50 to retain second portion 47 in aperture 54. For example, stop 48 may be received in a recess defined by an interior surface of insertion portion 58, thereby holding stop 48 and axle 46 in place relative to cap 50.

Cap 50 is coupled to transverse end 61 of its corresponding support 22. For example, as shown in the illustrated embodiment of FIG. 5, cap 50 may comprise an insertion portion 58 which may be received by and retained in support 22. Insertion portion 58 may comprise a retention member 59 (e.g. a tab 59) which engages support 22 to assist and retaining insertion portion 58 in support 22.

Panels 24 may be coupled the supports 22 by any suitable technique. For example, panels 24 may be frictionally gripped (e.g. by clamps coupled to supports 22), hung (e.g. by hooks coupled to supports 22 engaged in apertures defined in panels 22), retained (e.g. as shown in FIG. 6), or otherwise coupled to supports 22.

In some embodiments, mount 30 comprises a flange 70. Flanges 70 on adjacent supports 22 may abut each other (e.g. while canopy 20 is retracted), thereby spacing apart supports 22 and their corresponding engagement members 32. This may prevent adjacent engagement members 32 from "binding", which may occur when engagement members 32 abut and may inhibit movement of engagement members 32 in track 26.

Flange 70 may extend in longitudinal direction 6 and/or other directions extending radially outward (i.e. in directions orthogonal to transverse direction 8) from engagement member 32. For example, in the embodiment depicted in FIGS. 4 and 5, flange 70 extends radially outward from insertion portion 58 in nearly all radial directions. Flange 70 may extend further radially outward in directions other than longitudinal direction 6 (e.g. extending further "up" or "down" in the orientation shown in FIG. 5). Such a shape may discourage adjacent flanges 70 from rotating while such adjacent flanges 70 are abutting (e.g. while canopy 20 is retracted). Flanges 70 may thus discourage support 22 from rotating about an axis parallel to transverse direction 8 while canopy 20 is retracted. One or more surfaces of flange 70 may be sloped, curved, or otherwise shaped to promote a particular orientation of supports 22 while canopy 20 is retracted.

Figure 6:
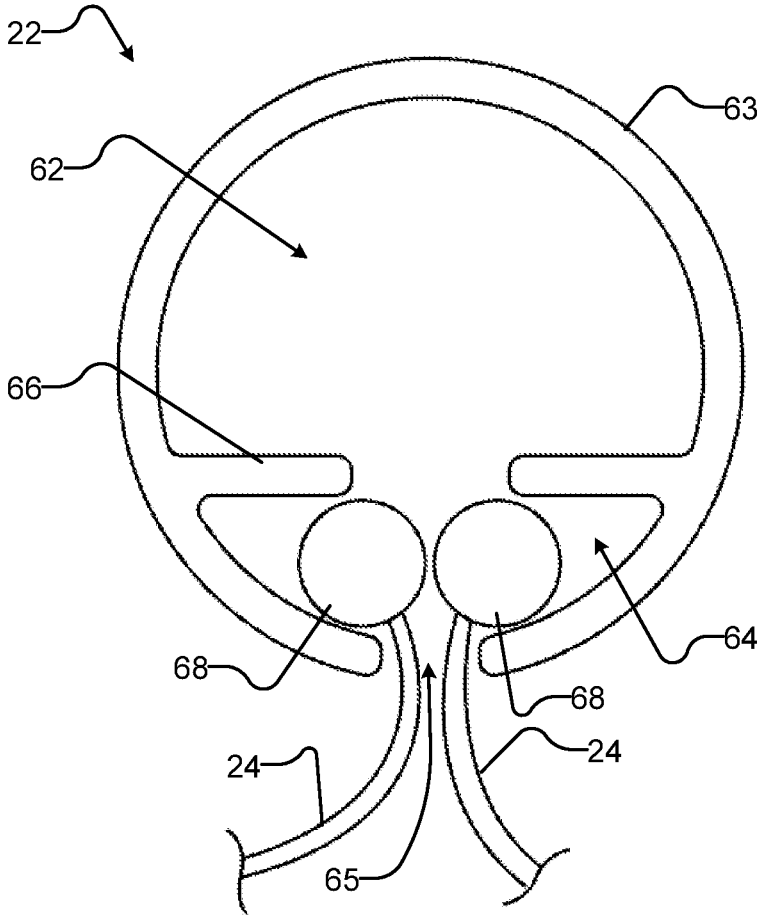
FIG. 6 is a cross-sectional view of the example support of FIG. 3.

FIG. 6 shows an example embodiment of support 22 in cross-section. The example support 22 comprises a body 63 which defines a first cavity 62 shaped for receiving cap 50 (e.g. for receiving insertion portion 58 of cap 50) and a second cavity 64 for receiving portions of one or more panels 24. For example, panels 24 may comprise panel retainers 68 which are retained in second cavity 64. Panels 24 may extend outside of support 22 through aperture 65, which may run along a surface of support 22 in transverse direction 8. Cavities 62, 64 may be divided by divider 66, which may be shaped to retain one or more panel retainers 68 in second cavity 64 and/or to receive insertion portion 58 of cap 50. In some embodiments, cavities 62, 64 may be in communication with each other; in other embodiments, cavities 62, 64 may be entirely separated by divider 66. In some embodiments, divider 66 is not necessary.

In some embodiments, panels 24 may comprise panel retainers 68 having a dimension greater than a dimension of aperture 65. For example, a panel retainer 68 may comprise a cord sewn along an edge of a panel 24, a seam where panel 24 is folded back on itself (to provide additional thickness), a rod attached to an edge of panel 24, and/or any other suitable shape for providing a greater dimension to a portion of panel 24. Second cavity 64 may be open-ended at one or more of its transverse ends 61 (e.g. where mounts 30 are coupled to supports 22), thereby permitting panel retainers 68 to slide into second cavity 64 in transverse direction 8 through opening 63 (see FIG. 5). Mounts 30 may retain panel retainers 68 in second cavity 64 when coupled to support 22, e.g. by blocking all or part of opening 63.

In some embodiments, aperture 65 has a longitudinal dimension of 0.5 cm (0.2 inches), and panel retainers 68, when positioned inside second cavity 64, have a longitudinal dimension greater than 0.5 cm (0.2 inches).

In some embodiments, canopy 20 comprises a leader 80, by which a user may extend and/or retract canopy 20. Leader 80 provides a coupling mechanism by which one or more supports 22 may be coupled to a mover for moving supports 22. The mover (not shown) may comprise any suitable mechanism for providing force to move supports 22, such as a motor, a person, etc. For example, leader 80 may comprise lead line 80A of FIG. 3 coupled to first support 22A. A user may couple a handle (not shown) to lead line 80A (e.g. by passing lead line 80A through a hooked end of the handle) and pull support 22A in longitudinal direction 6. When canopy 20 is being retracted, first support 22A may push other supports 22 in longitudinal direction 8. When canopy 20 is being expanded, first support 22A may pull on canopy panel(s) 24 coupled thereto, thereby pulling along second support 22B in longitudinal direction 8. Likewise, second support 22B may push or pull other supports 22.

In some embodiments, magnets 72 are coupled to one or more supports 22 for magnetically attracting other supports 22. For example, each support 22 may be coupled to a magnet 72 oriented to attract an oppositely-oriented magnet 72 coupled to an adjacent support 22. Alternatively, or in addition, some supports 22 may be coupled to magnets 72 for attracting adjacent supports 22 which comprise magnetically-attractive materials (e.g. iron, suitable alloys, etc.). Magnets 72 may be discrete objects coupled to support 22 (as shown, for example, in FIGS. 6 and 7) or may be integrally formed with supports 22. For example, supports 22 may comprise a ferromagnetic material, and one or more supports 22 may be magnetized.

Figure 7:
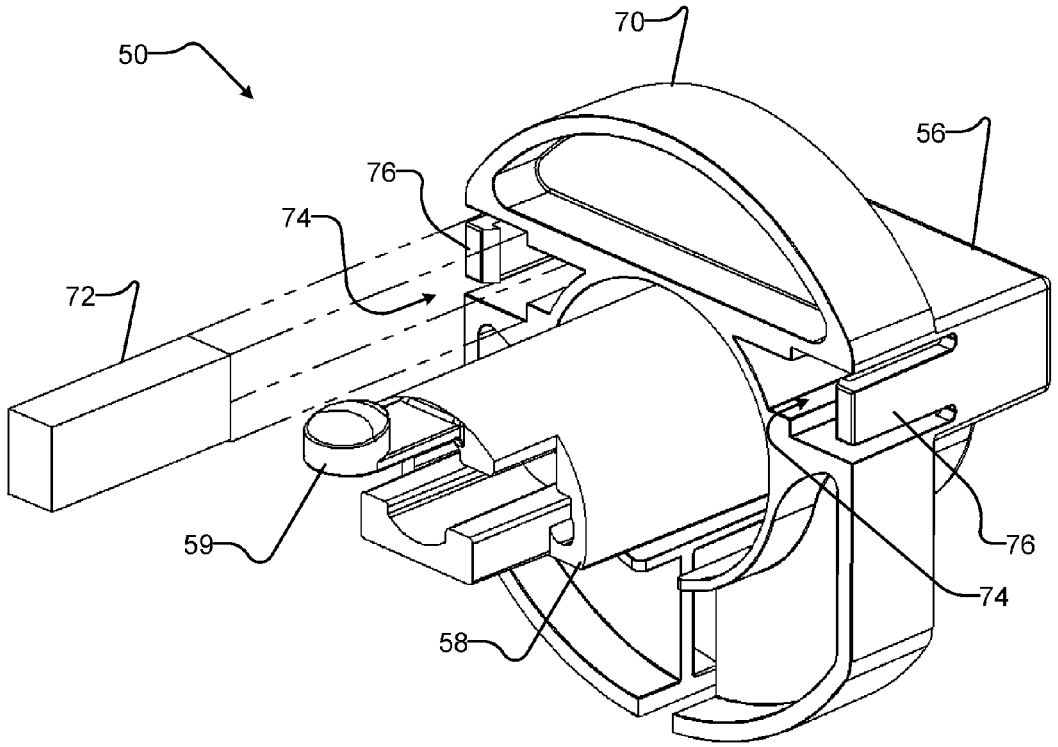
FIG. 7 is a perspective view of an example cap shown in FIG. 5, shown from a different perspective than in FIG. 5.

FIG. 7 is a perspective view of cap 50, showing the reverse side of cap 50 (relative to the view of FIG. 5). In the example embodiment depicted in FIGS. 5 and 7, cap 50 comprises a cavity 74 for receiving magnet 72. Once received in cavity 74, magnet 72 may be retained by retainer 76. Cap 50 may comprise one or more cavities 74 for retaining magnet 72; for example, cap 50 may comprise two cavities 74 on opposing sides of cap 50. Adjacent caps 50 may be provided with oppositely oriented magnets 72 in adjacent cavities 74.

Aspects of the present disclosure comprise a kit of parts for assembling canopy 20. Parts of canopy 20, such as supports 22, canopy panels 24, tracks 26, and/or mounts 30 (and/or constituent parts thereof) may be packaged together or separately, coupled or uncoupled, for assembly by a user.

Aspects of the present disclosure provide a method for assembling canopy 20. Such methods may comprise spacing apart tracks 26 appropriately and coupling supports 22 to tracks 26 so that tracks 26 and supports 22 extend in longitudinal direction 6 and transverse direction 8, respectively, as described above. Such methods may further comprise coupling various elements of canopy 20 to each other. For example, the method may comprise coupling mount 30 to a support 22 (e.g. via a retention member 59 and aperture 69) and to track 26 (e.g. via wheel 32A and protrusion 33). The method may comprise coupling the elements of mount 30 (e.g. engagement member 32, axle 41, bias mechanism 40, stop 48, cap 50, flange 70, and/or other elements) together to form mount 30. The coupling of particular elements is described in greater detail above.

INTERPRETATION OF TERMS

Unless the context clearly requires otherwise, throughout the description and the claims:

"comprise", "comprising", and the like are to be construed in an inclusive sense, as opposed to an exclusive or exhaustive sense; that is to say, in the sense of "including, but not limited to";

"connected", "coupled", or any variant thereof, means any connection or coupling, either direct or indirect, between two or more elements; the coupling or connection between the elements can be physical, logical, or a combination thereof; elements which are integrally formed may be considered to be connected or coupled;

"herein", "above", "below", and words of similar import, when used to describe this specification, shall refer to this specification as a whole, and not to any particular portions of this specification;

"or", in reference to a list of two or more items, covers all of the following interpretations of the word: any of the items in the list, all of the items in the list, and any combination of the items in the list;

the singular forms "a", "an", and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A retractable canopy comprising:

first and second tracks extending in a longitudinal direction and spaced apart from one another in a transverse direction;

a first support extending transversely between the first and second tracks, wherein the first support comprises a transversely opening mounting cavity for receiving the mount and a transversely opening panel cavity for receiving at least the first portion of the canopy panel;

mounts for movably coupling the first support to the first and second tracks, the mounts comprising a first mount for movably coupling the first support to the first track, the first mount comprising:

an engagement member engaged to the first track;

a bias mechanism coupled between the engagement member and the first support, the bias mechanism resiliently forcing the engagement member transversely away from the first support; and a cap, the cap comprising a body abutting a first transverse end of the first support and a retention member extending transversely into the mounting cavity and retained by the first support; and a flexible canopy panel, at least a first portion of the canopy panel coupled to the first support;

wherein the cap defines an axle cavity extending in the transverse direction and wherein the bias mechanism comprises:

an axle coupled at a first axle portion to the engagement member and at a second axle portion to the cap, the first axle portion slidably movable relative to the second axle portion, and the second axle portion received by the axle cavity;

a stop coupled to the second axle portion and the cap; and a spring retained between the first axle portion and the stop, the spring resiliently biasing the first axle portion away from the stop and toward the track cavity.

2. A retractable canopy according to claim 1 wherein the engagement member comprises a wheel and the first track comprises a track cavity for receiving the wheel, the wheel movable in the longitudinal direction within the track cavity.

3. A retractable canopy according to claim 2 wherein the first track comprises a protrusion extending into the track cavity, the protrusion extending along the first track in the longitudinal direction, and a circumferential surface of the wheel comprises a groove shaped to receive the protrusion during movement of the wheel in the longitudinal direction within the track cavity.

4. A retractable canopy according to claim 2 wherein the first track comprises a groove defined along a surface of the track cavity, the groove extending along the first track in the longitudinal direction, and a circumferential surface of the wheel comprises a protrusion shaped to be received the groove during movement of the wheel in the longitudinal direction within the track cavity.

5. A retractable canopy according to claim 3 wherein the protrusion comprises a convex surface and the groove comprises a concave surface which is shaped to be complementary to the convex surface.

6. A retractable canopy according to claim 1 wherein:

the panel cavity extends in the transverse direction along the first support;

the first support defines a panel aperture extending in the transverse direction along a surface of the first support;

the canopy panel comprises a panel retainer coupled to the first portion of the canopy panel, the panel retainer extending in the transverse direction and retained in the panel cavity, the panel retainer having a cross-sectional retainer dimension greater than a cross-sectional aperture dimension of the panel aperture, the canopy panel passing through the panel aperture.

7. A retractable canopy according to claim 6 comprising:

a second support extending transversely between the first and second tracks; and a second canopy panel, at least a portion of the second canopy panel coupled to the second support, the second canopy panel comprising a second panel retainer extending in the transverse direction and retained in the panel cavity of the first support;

wherein a second cross-sectional retainer dimension of the second panel retainer is greater than the cross-sectional aperture dimension of the panel aperture; and the sum of the cross-sectional retainer dimension and second cross-sectional retainer dimension is less than a cross-sectional dimension of the panel cavity of the first support.

8. A retractable canopy comprising:

first and second tracks extending in a longitudinal direction and spaced apart from one another in a transverse direction;

a first support extending transversely between the first and second tracks, wherein the first support comprises a transversely opening mounting cavity for receiving the mount and a transversely opening panel cavity for receiving at least the first portion of the canopy panel;

mounts for movably coupling the first support to the first and second tracks, the mounts comprising a first mount for movably coupling the first support to the first track, the first mount comprising:

an engagement member engaged to the first track; and a bias mechanism coupled between the engagement member and the first support, the bias mechanism resiliently forcing the engagement member transversely away from the first support; and a cap, the cap comprising a body abutting a first transverse end of the first support and a retention member extending transversely into the mounting cavity and retained by the first support;

a flexible canopy panel, at least a first portion of the canopy panel coupled to the first support;

a second support extending transversely between the first and second tracks; and a first magnet coupled to the first support, the first magnet attracting the first support toward the second support.

9. A retractable canopy according to claim 8 wherein the cap defines an axle cavity extending in the transverse direction and wherein the bias mechanism comprises:

an axle coupled at a first axle portion to the engagement member and at a second axle portion to the cap, the first axle portion fixed relative to the second axle portion, and the second axle portion retained in the axle cavity;

a stop defined in the axle cavity by the cap;

a spring retained between the second axle portion and the stop, the spring resiliently biasing the axle away from the stop and toward the track cavity.

10. A retractable canopy according to claim 8 wherein:

the cap comprises a magnet cavity;

the first magnet is retained by the magnet cavity; and a second magnet is coupled to the second support, the second magnet magnetically attracted toward the first magnet.

11. A kit of parts for assembling a retractable canopy, the kit of parts comprising:

first and second tracks extending in a longitudinal direction and positionable so that the first track is spaced apart from the second track in a transverse direction;

a first support extending in an extension direction and positionable to extend transversely between the first and second tracks, wherein the first support comprises a transversely opening mounting cavity for receiving the mount and a transversely opening panel cavity for receiving at least the first portion of the canopy panel;

mounts adapted to movably couple the first support to the first track and second tracks, the mounts comprising a first mount for movably coupling the first support to the first track, the first mount comprising:

an engagement member engageable with the first track;

a cap, the cap comprising a body positionable to abut a transverse end of the first support and a retention member positionable to extend transversely into the mounting cavity and adapted to be retained by the first support; and a bias mechanism coupleable between the engagement member and the first support to resiliently force the engagement member transversely away from the first support;

a flexible canopy panel, at least a first portion of the canopy panel coupleable to the first support;

wherein the cap defines an axle cavity, the axle cavity extending in the extension direction when the retention member is retained by the first support and wherein the bias mechanism comprises:

an axle coupleable at a first axle portion to the engagement member and at a second axle portion to the cap, the first axle portion slidably movable relative to the second axle portion, and the second axle portion receivable by the axle cavity;

a stop coupleable to the second axle portion and the cap; and a spring to be retained between the first axle portion and the stop, the spring resiliently biasing the first axle portion away from the stop and toward the track cavity when retained by the first axle portion and the stop.

12. A kit of parts according to claim 11 wherein the engagement member comprises a wheel and the first track comprises a track cavity for receiving the wheel, the wheel movable in the longitudinal direction within the track cavity when received by the track cavity.

13. A kit of parts according to claim 12 wherein the first track comprises a protrusion extending into the track cavity, the protrusion extending along the first track in the longitudinal direction, and a circumferential surface of the wheel comprises a groove shaped to receive the protrusion during movement of the wheel in the longitudinal direction within the track cavity.

14. A kit of parts according to claim 12 wherein the first track comprises a groove defined along a surface of the track cavity, the groove extending along the first track in the longitudinal direction, and a circumferential surface of the wheel comprises a protrusion shaped to be received the groove during movement of the wheel in the longitudinal direction within the track cavity.

15. A kit of parts according to claim 13 wherein the protrusion comprises a convex surface and the groove comprises a concave surface adapted to interface with the convex surface.

16. A kit of parts according to claim 11 wherein:

the panel cavity extends in the extension direction along the first support;

the first support defines a panel aperture extending in the extension direction along a surface of the first support;

the canopy panel comprises a panel retainer coupleable to the first portion of the canopy panel, the panel retainer positionable to extend in the transverse direction and adapted to be retained in the panel cavity, the panel retainer having a cross-sectional retainer dimension greater than a cross-sectional aperture dimension of the panel aperture, the canopy panel positionable to pass through the panel aperture while the panel retainer is retained in the panel cavity.

17. A kit of parts according to claim 16 comprising:

a second support positionable to extend transversely between the first and second tracks; and a second canopy panel, at least a portion of the second canopy panel coupleable to the second support, the second canopy panel comprising a second panel retainer positionable to extend in the transverse direction and to be retained in the panel cavity of the first support;

wherein a second cross-sectional retainer dimension of the second panel retainer is greater than the cross-sectional aperture dimension of the panel aperture; and the sum of the cross-sectional retainer dimension and second cross-sectional retainer dimension is less than a cross-sectional dimension of the panel cavity of the first support.

18. A kit of parts for assembling a retractable canopy, the kit of parts comprising:

first and second tracks extending in a longitudinal direction and positionable so that the first track is spaced apart from the second track in a transverse direction;

a first support extending in an extension direction and positionable to extend transversely between the first and second tracks, wherein the first support comprises a transversely opening mounting cavity for receiving the mount and a transversely opening panel cavity for receiving at least the first portion of the canopy panel;

mounts adapted to movably couple the first support to the first track and second tracks, the mounts comprising a first mount for movably coupling the first support to the first track, the first mount comprising:

an engagement member engageable with the first track;

a cap, the cap comprising a body positionable to abut a transverse end of the first support and a retention member positionable to extend transversely into the mounting cavity and adapted to be retained by the first support; and a bias mechanism coupleable between the engagement member and the first support to resiliently force the engagement member transversely away from the first support;

a flexible canopy panel, at least a first portion of the canopy panel coupleable to the first support;

a second support extendable transversely between the first and second tracks; and a first magnet for attracting the first support to the second support, the first magnet coupleable to the first support.

19. A kit of parts according to claim 18 wherein:

the cap defines an axle cavity, the axle cavity extending in the extension direction when the retention member is retained by the first support; and the bias mechanism comprises:

an axle coupleable at a first axle portion to the engagement member and at a second axle portion to the cap, the first axle portion fixed relative to the second axle portion, and the second axle portion adapted to be retained in the axle cavity;

a stop defined in the axle cavity by the cap;

a spring to be retained between the second axle portion and the stop, the spring resiliently biasing the first axle portion away from the stop and toward the track cavity when retained by the second axle portion and the stop.

20. A kit of parts according to claim 18 comprising a second magnet coupleable to the second support, wherein the cap comprises a magnet cavity, the first magnet is retainable by the magnet cavity, and the second magnet is magnetically attracted toward the first magnet while the first magnet is retained by the magnet cavity and the second magnet is coupled to the second support.

* * * * *